United States Patent [19]

Martin

[11] Patent Number: 4,973,287

[45] Date of Patent: Nov. 27, 1990

[54] SIMULATIVE CHECK OUT STATION

[76] Inventor: Cynthia L. Martin, 106 Bowman, Harrisonville, Mo. 64701

[21] Appl. No.: 369,521

[22] Filed: Jun. 21, 1989

[51] Int. Cl.[5] ..... A63H 33/30

[52] U.S. Cl. ..... 446/479; 446/143; 446/129

[58] Field of Search ..... 446/8, 143, 330, 424, 446/479, 130, 129, 484; 235/467

[56] References Cited

U.S. PATENT DOCUMENTS 3,806,706 4/1974 Hasslinger et al. ..... 235/467 X 4,007,377 2/1977 Simon et al. ..... 235/467 X 4,064,390 12/1977 Hildebrand et al. ..... 235/467 X 4,623,877 11/1986 Buckens ..... 340/551 X

*Primary Examiner*—Mickey Yu

*Attorney, Agent, or Firm*—T. M. Gernstein

[57] ABSTRACT

A toy check out station simulates the action of an actual check out station by including a work supporting surface, a system that simulates the action of a bar code reader system, a cash register and a conveyor system. The station includes a plurality of objects that have identifying discs thereon and which are passed over a field generator. When the field of the generator is broken by the discs, a signal is actuated so that each individual item can have its own code according to the number of discs thereon.

1 Claim, 2 Drawing Sheets

SIMULATIVE CHECK OUT STATION

TECHNICAL FIELD OF THE INVENTION

The present invention relates to the general art of amusement devices, and to the particular field of toys. Specifically, the present invention relates to simulative toys.

BACKGROUND OF THE INVENTION

Children enjoy playing adult simulating role games. For example, games simulating shopping have always been popular, and there have been numerous toy stores proposed in response to this popularity.

While there have been numerous toy store devices known, the inventor is not aware of any such devices which accurately simulate a modern check-out station, such as might be found in a modern grocery store. Since shopping in general, and grocery shopping in particular, is an important aspect of everyday adult life, and since children's games are often patterned after everyday life, there is a need for a toy which accurately simulates a grocery store check-out station.

More important than simply providing amusement for children, many games can be used to teach children valuable lessons in life situations and skills that will serve them well in later life. For example, many games are directed to teaching reading skills, or teaching math skills, or the like. It is usually an objective of these games to be enjoyable as well as to be instructive; however, this object is not always achieved.

Therefore, there is a need for a game device for use by children that is not only enjoyable to use, but will also teach the children valuable skills, especially skills associated with shopping, such as in a grocery store.

OBJECTS OF THE INVENTION

It is a main object of the present invention to provide a game device for use by children that is enjoyable in use, yet is also instructive.

It is another object of the present invention to provide a game device for use by children that accurately simulates a grocery store check out station.

It is another object of the present invention to provide a grocery store check out station simulative toy that teaches children counting, and other basic arithmetic skills.

SUMMARY OF THE INVENTION

These, and other, objects are achieved by a toy that accurately simulates a grocery store check-out station and which includes a cash register that is coupled to a simulative bar code reader. The cash register operates in conjunction with the simulative bar code reader, and a conveyor system is also included.

By including the simulative bar code reader, the toy of the present invention is able to not only simulate an actual checkout station, but can also teach the child counting skills. By coupling the simulative bar code reader to the cash register, the counting and arithmetic skills of the child can be challenged and checked.

However, even though the toy is teaching the child basic skills and exposing the child to a real life situation, the toy remains enjoyable to use and fascinating for the child.

DETAILED DESCRIPTION OF THE PREFERRED EMBODIMENT OF THE INVENTION

Figure 1:
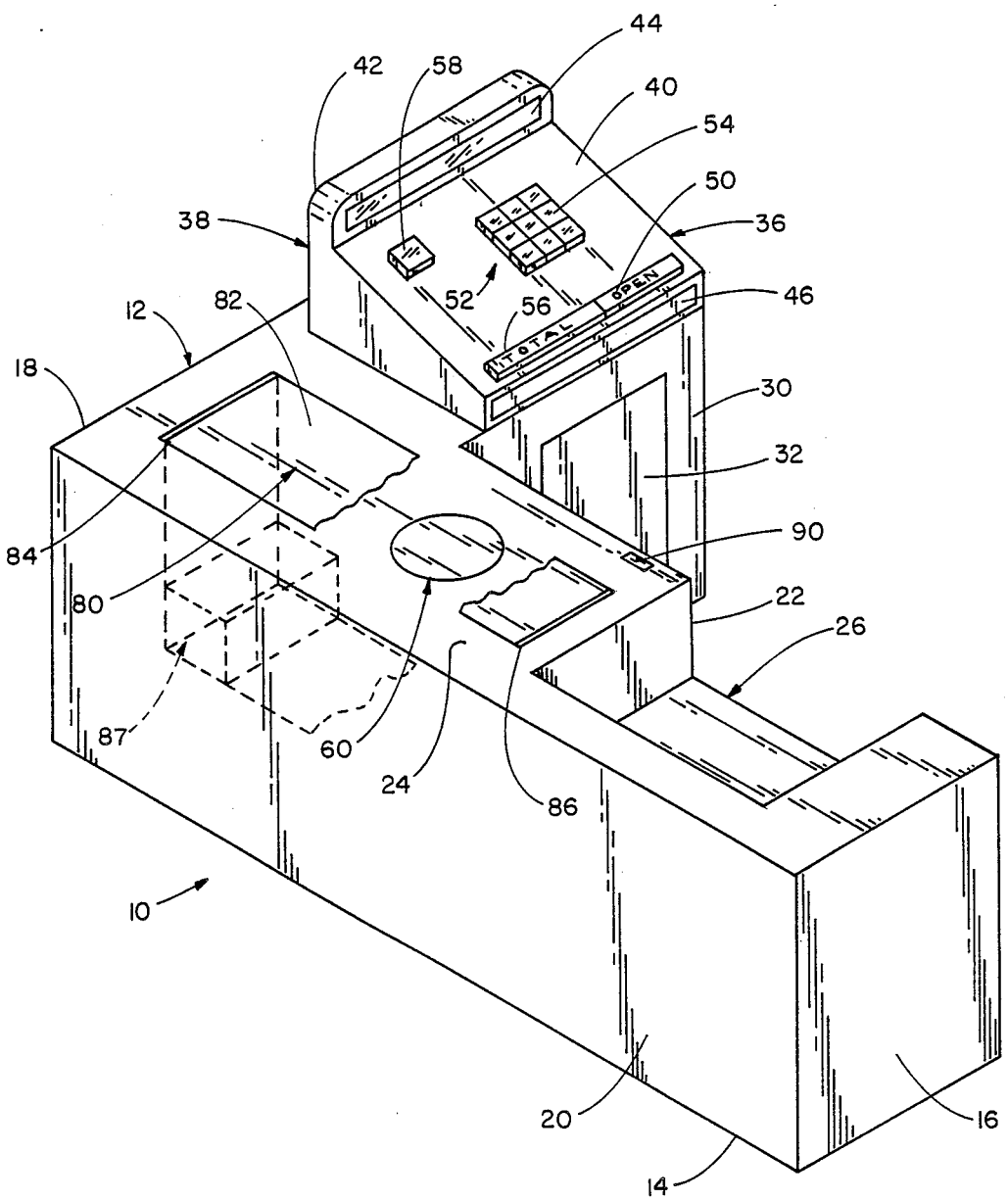
FIG. 1 is perspective view of the toy embodying the present invention.

Shown in FIG. 1 is a toy check-out station 10 that can simulate a grocery store check-out station, or any other similar check-out station. The station 10 includes a counter unit 12 that can be formed of plastics-type material or the like and is sized for a child. The counter unit 12 preferably is monolithic, but can be formed of several sections if suitable.

The counter unit 12 includes a base 14, ends 16 and 18, a front side 20 and a rear side 22, and a work supporting surface 24. The child stands behind the counter unit and items to be "checked out" are moved across the work supporting surface 24 in the fashion of a normal check out station from the rear end 18 towards the front end 16.

The unit 12 includes a shelf 26 which is used to "bag" the merchandise or can be used as a storage shelf or the like as the child desires. Extra "bags" can be stored on this shelf and used to package the items checked out at the station 10.

The unit 12 also includes a cash register supporting section 30 having a cutout portion 32 located therein for storage or the like. The cash register supporting section is located adjacent to the work supporting surface as is the case in an actual check out station.

A cash register unit 36 is supported on the supporting section 30, and includes a body 38 having an upper surface 40, a rear surface 42, and a read out portion 44 thereon. The cash register unit 36 also includes a drawer 46 that is spring biased to open when released, and a latch mechanism that keeps the drawer closed. The latch and spring biasing mechanisms are not shown in the figures as they are common to the art, and those skilled in the art will understand how to assemble such mechanisms from the teachings in the art. The opening latch is operated by a release button 50 on the upper surface of the cash register body, and the drawer is closed by forcing it back into the cash register body against the force of the internal spring until the latch catches the drawer. The latch can be spring biased as well to automatically move into a latching configuration when the drawer is closed.

The read out portion 44 includes a digital display that is coupled to a keyboard 52 to display the numbers and other indicia associated With the keyboard keys, such as key 54. The circuits connecting the keys to the digital numbers, which can be LED or the like, will not be discussed since those skilled in the art will understand how to connect a LED display to number keys to display a number when that key is depressed.

A signal element 58 is also mounted on the keyboard, and the function of this signal element will be discussed later. In the preferred embodiment, the keys 54 of the register are connected to a calculator microchip, and a total bar 56 is included to operated the equals function of the calculator. The chip is set to automatically add each item keyed in via the keys 54 and to display the total upon depressing the total bar 56. The chip can also be programmed to include multiplication functions as well if so desired, and the totals and sums will always be displayed on the register display portion 44.

The check out station 10 further includes an object detector system 60 that simulates a bar code reader system of an actual check out station, without the cost of such a system. The object detector system includes an object detector element located in the work supporting surface 24 in a position to be passed over by an object being moved along the work surface toward the end 16 of the counter unit. As the object passes over the detector element 60, a signal is sent to the signal element 58 to cause that element to emit a light or an audible sound as the object passes over the detector.

Figure 2:
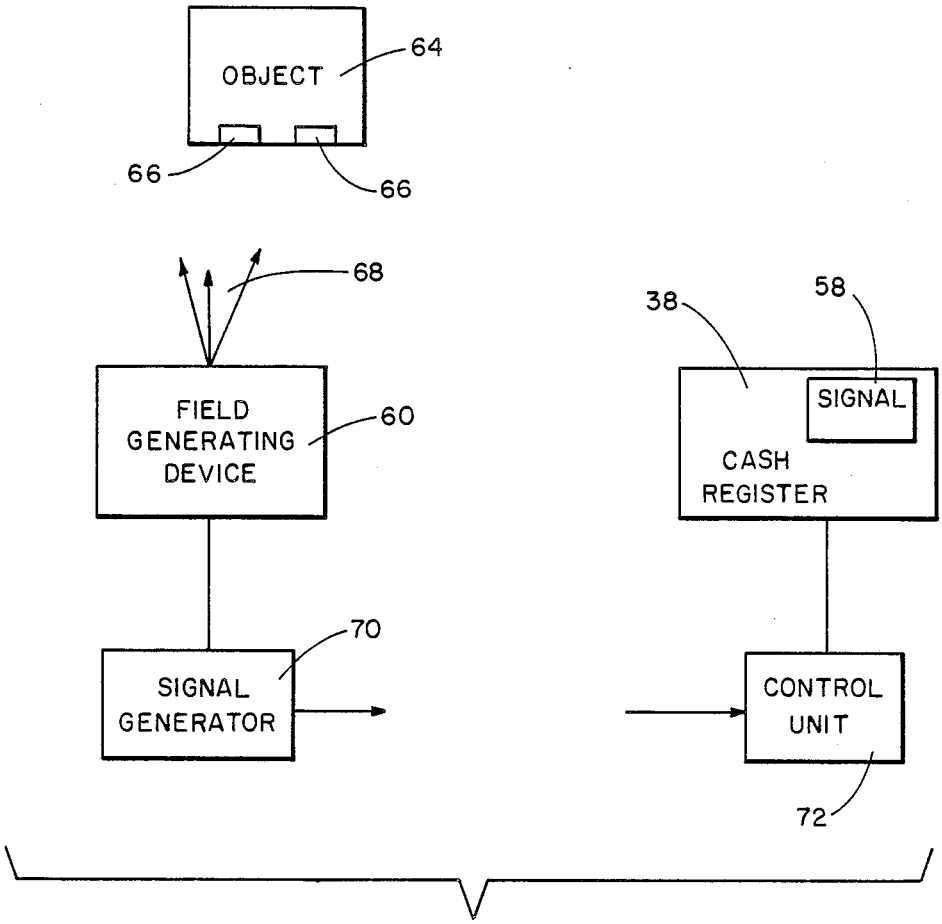
FIG. 2 is a schematic of a simulative bar code reader used in conjunction with the toy of the present invention.

The detector system 60 is shown schematically in FIG. 2, and attention is now adverted thereto. Each object, indicated in FIG. 2 as object 64 includes one or more metal discs 66 affixed thereto, and the detector induces a field 68 upwards from the work supporting surface. As the object passes through the field, the metal discs interrupt the field. The system 60 includes circuitry 70 that emits a signal every time the field is interrupted. This signal is sent to a control unit 72, that operates the signal element 58 on the cash register.

The preferred form of the detector system 60 is fashioned after the systems used to detect and count metal parts on a conveyor system, and suitable systems are shown in U.S. Pat. Nos. 4,232,265, 4,310,797, 4,314,202 and 4,528,856, the disclosure of which is fully incorporated herein by reference. Other suitable systems are modeled after systems known as event counters, such as an event counter using a photoelectric cell. In such a case, the photoelectric cell is substituted for the detector and a light source is located adjacent to the work station and the conveyor in substitution for the metal discs 66, and suitable relays, registers and the like are included as will occur to those skilled in the art familiar with this technology and based on the disclosure herein and with reference to textbooks such as "Industrial Instrumentation", by Considine, and published by Wiley and Sons, and the like.

Each object will have several metal discs affixed thereto so that the signal 58 will be actuated a plurality of times for a particular object. Such action simulates the bar code reader action, yet the system 60 is not nearly as expensive as an actual bar code reader.

The detector system 60 is used in conjunction with a conveyor system which includes a conveyor 80 located in the work supporting surface of the station. The conveyor 80 includes an endless belt 82 that has been cut off in FIG. 1 for the sake of clearly showing the detector element 60, but which actually extends over such element from a feed slot 84 to a take-up slot 86. A motor unit 87 having drive gears (not shown) is mounted beneath the counter working surface to drive the conveyor across the work supporting surface. The details of the conveyor system are not shown since those skilled in the art will understand how to construct the conveyor based on the foregoing disclosure.

An on/off switch 90 connects all of the above-discussed systems to a source of power when desired and turns off all of these systems when desired.

The reality of the station can be enhanced by including name tags, signs and the like as will be found in an actual check out station.

It is understood that while certain forms of the present invention have been illustrated and described herein, it is not to be limited to the specific forms or arrangements of parts described and shown.

I claim:

1. A simulative check out station comprising:

(A) a counter unit which includes
  (1) a work supporting surface,
  (2) a storage shelf in said counter unit adjacent to said work supporting surface,
  (3) a cash register supporting element located adjacent to said work supporting surface;

(B) a cash register unit supported on said cash register support element and including
  (1) a digital read out portion, and
  (2) a drawer, (c) a plurality of objects which are to be supported on said work supporting surface, each object including a metal disc affixed thereto;

(d) an object detector system which includes
  (1) field generator that generates a magnetic field, said field generator being located in said work supporting surface to generate a magnetic field that extends upwards from said work station supporting surface,
  (2) circuit means connected to said field generator and including signal means emitting a signal every time said magnetic field is interrupted, and
  (3) said signal means including visible signal means on said cash register connected to said circuit means to be activated thereby in response to said magnetic field being interrupted;

(e) a conveyor unit on said work supporting surface and including
  (1) an endless belt,
  (2) a feed slot defined through said work supporting surface on one side of said field generator,
  (3) a take-up slot defined through said work supporting surface on another side of said field generator, and
  (4) means for moving said endless belt from said feed slot across said work supporting surface over said field generator and into said take-up slot to move in front of said field generator whereby any objects on said endless belt will pass through said magnetic field and any metal discs affixed to said objects will interrupt said magnetic field.

* * * * *